US005657563A

United States Patent [19]

Lane

[11] Patent Number: 5,657,563

[45] Date of Patent: Aug. 19, 1997

[54] PICTURE ILLUMINATION DISPLAY DEVICE

[76] Inventor: Patrick Lane, 195 Kuukama St., Kailua, Hi. 96734

[21] Appl. No.: 568,567

[22] Filed: Dec. 7, 1995

[51] Int. Cl.[6] ..... G09F 13/12

[52] U.S. Cl. ..... 40/219; 40/442; 40/716; 40/714

[58] Field of Search ..... 40/219, 442, 564, 40/715, 716, 717, 748, 900

[56] References Cited

U.S. PATENT DOCUMENTS

| | | | |
|---|---|---|---|
| 1,348,957 | 8/1920 | Pope | 362/247 X |
| 2,677,909 | 5/1954 | Heydenryk | 40/714 |
| 4,819,353 | 4/1989 | Glucksman et al. | 40/716 |
| 4,922,384 | 5/1990 | Torrence | 40/219 X |
| 5,123,192 | 6/1992 | Hsieh | 40/442 |
| 5,359,374 | 10/1994 | Schwartz | 40/717 X |

*Primary Examiner*—Brian K. Green
*Attorney, Agent, or Firm*—Michael I. Kroll

[57] ABSTRACT

A picture illumination display device (10) comprising a picture frame (12). A one-way mirror (14) is in the picture frame (12), so that when a person normally looks into the one-way mirror (14) a reflection will be seen. A picture (16) is carried in the picture frame (12) behind the one-way mirror (14). A facility (18) behind the picture (16), is for producing light. Once the light producing facility (18) is activated an image of the picture (16) will be projected through the one-way mirror (14), to allow a person looking into the one-way mirror (14) to see the projected image from the picture (16).

13 Claims, 2 Drawing Sheets

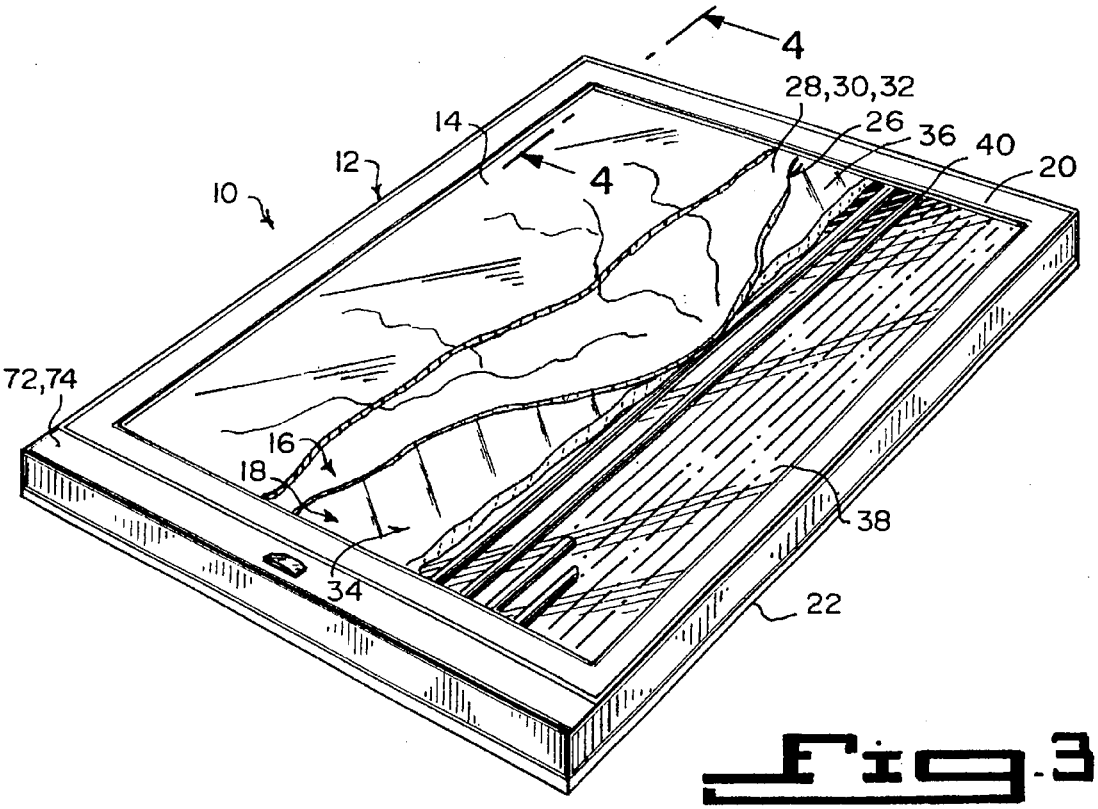
Fig. 3
Fig. 4
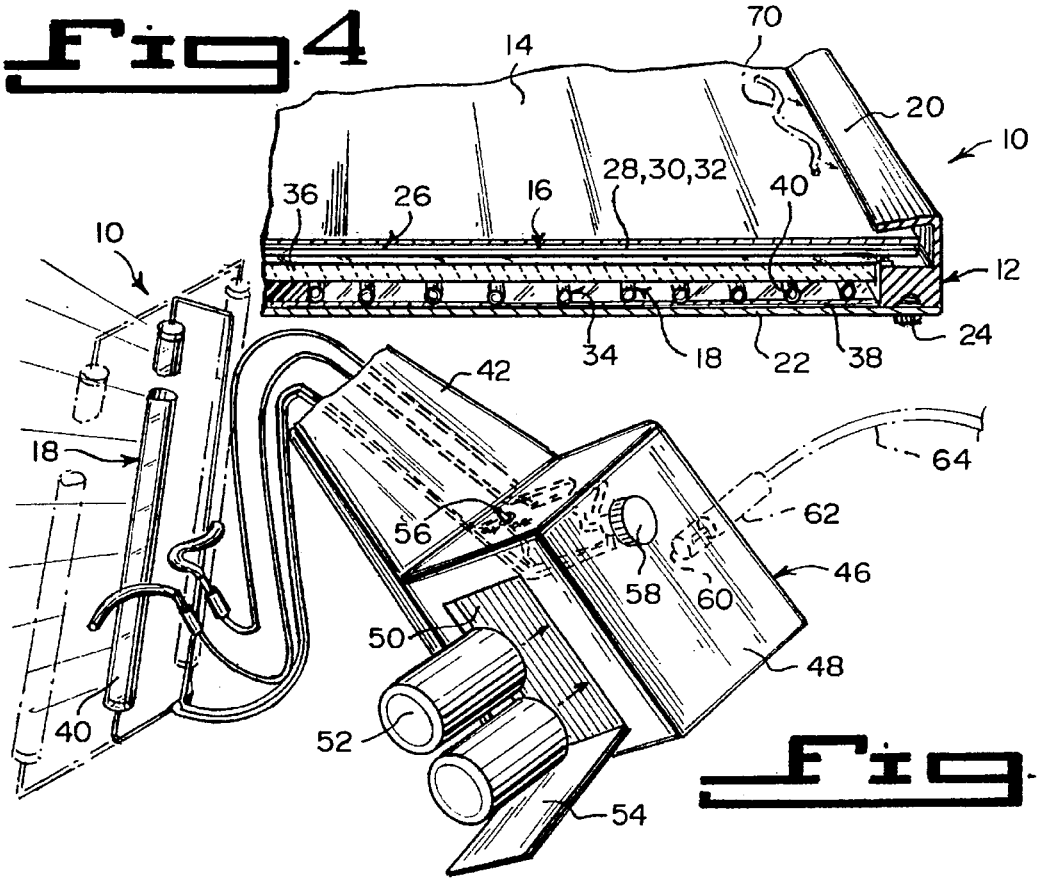
Fig. 5

PICTURE ILLUMINATION DISPLAY DEVICE

BACKGROUND OF THE INVENTION

1. Field of the Invention

The instant invention relates generally to picture frames and more specifically it relates to a picture illumination display device.

2. Description of the Prior Art

Numerous picture frames have been provided in prior art that are adapted to hold and exhibit various paintings, drawings or photographs, so that people can look at them. While these units may be suitable for the particular purpose to which they address, they would not be as suitable for the purposes of the present invention as heretofore described.

SUMMARY OF THE INVENTION

A primary object of the present invention is to provide a picture illumination display device that will overcome the shortcomings of the prior art devices.

Another object is to provide a picture illumination display device that will normally function as a mirror, but when an internal light is turned on a picture therein will be protected through the mirror to be seen by a person looking at the mirror.

An additional object is to provide a picture illumination display device whereby the mirror is a one-way type, which will allow the image of the picture therein once illuminated, to go out through the mirror.

A further object is to provide a picture illumination display device that is simple and easy to use.

A still further object is to provide a picture illumination display device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a front perspective view of the instant invention per se taken in the direction of arrow 3 in FIG. 1, with parts broken away and in section.

FIG. 4 is a cross section perspective view taken along line 4—4 in FIG. 3.

FIG. 5 is an enlarged perspective view of the area indicated by arrow 5 in FIG. 2, with parts broken away and in phantom.

Similar reference characters denote corresponding features consistently throughout the attached drawings.

DETAILED DESCRIPTION OF THE PREFERRED EMBODIMENTS

Figure 1:
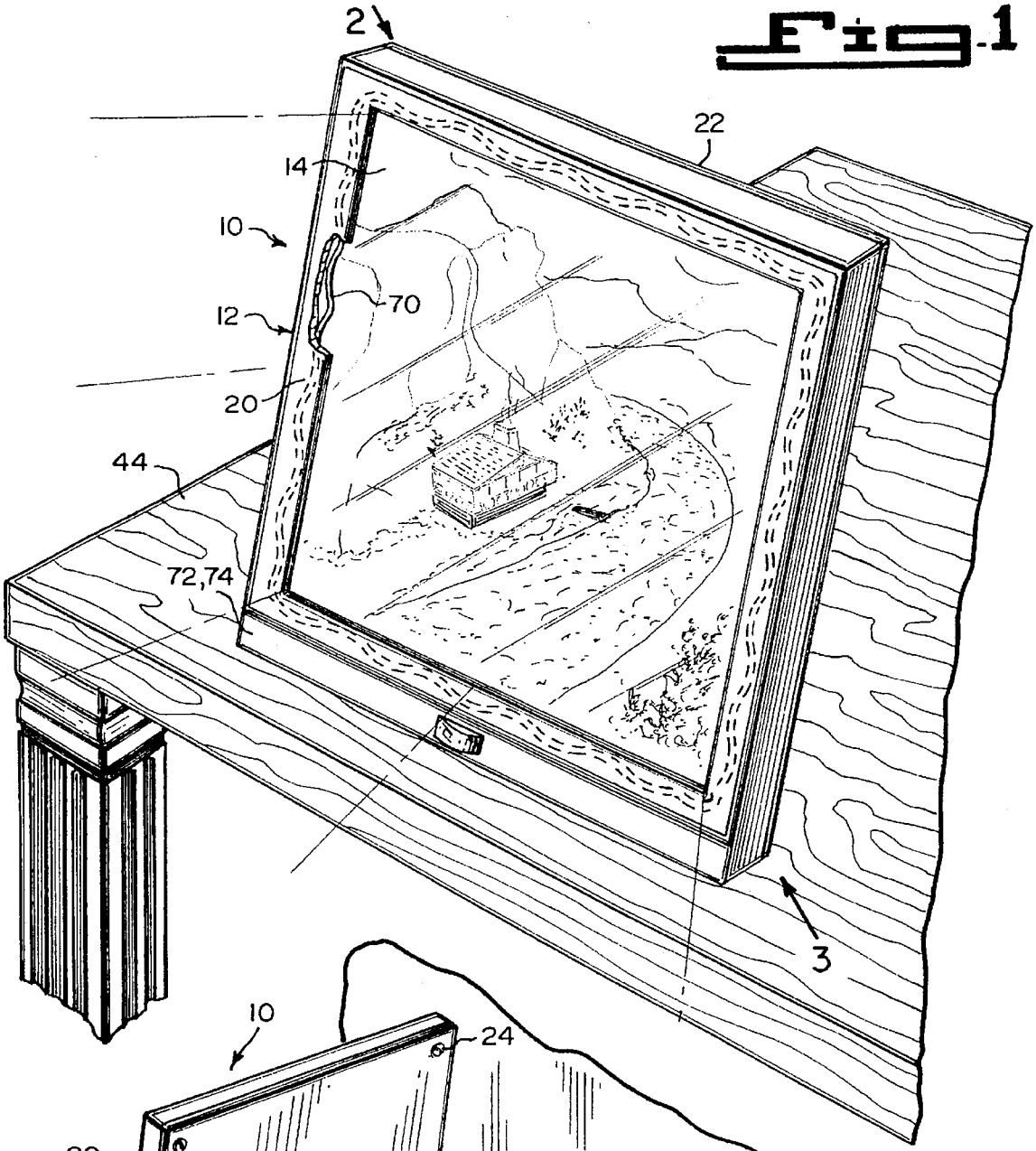
FIG. 1 is a front perspective view of the instant invention in use sitting upon a table, with parts broken away and in section.

Turning now descriptively to the drawings, in which similar reference characters denote similar elements throughout the several views, FIGS. 1 through 5 illustrate a picture illumination display device 10, comprising a picture frame 12. A one-way mirror 14 is in the picture frame 12, so that when a person normally looks into the one-way mirror 14 a reflection will be seen. A picture 16 is carried in the picture frame 12 behind the one-way mirror 14. A facility 18 behind the picture 16 is for producing light. Once the light producing facility 18 is activated an image of the picture 16 will be projected through the one-way mirror 14, to allow a person looking into the one-way mirror 14 to see the projected image from the picture 16.

The picture frame 12 includes a molding 20 thereabout to retain the one-way mirror 14 and the picture 16 therein. The picture frame 12 also includes a backing plate 22, to retain the light producing facility 18 therein.

A plurality of mounting screws 24 are for holding the backing plate 22 thereto in a removable manner. This allows a person to gain access to the light producing facility 18 to repair and replace the light producing facility 18 when needed.

The picture 16 can be a photographic slide 26. The photographic slide 26 can be in the form of a photograph 28, a painting 30 or a drawing 32 visually represented thereon.

The light producing facility 18 is a light bar assembly 34. The light bar assembly 34 consists of a transparent panel 36 and a mirrored panel 38. A plurality of cylindrical lamps 40 are electrically connected together and placed in a parallel arrangement between the first transparent panel 36 and the mirrored panel 38.

Figure 2:
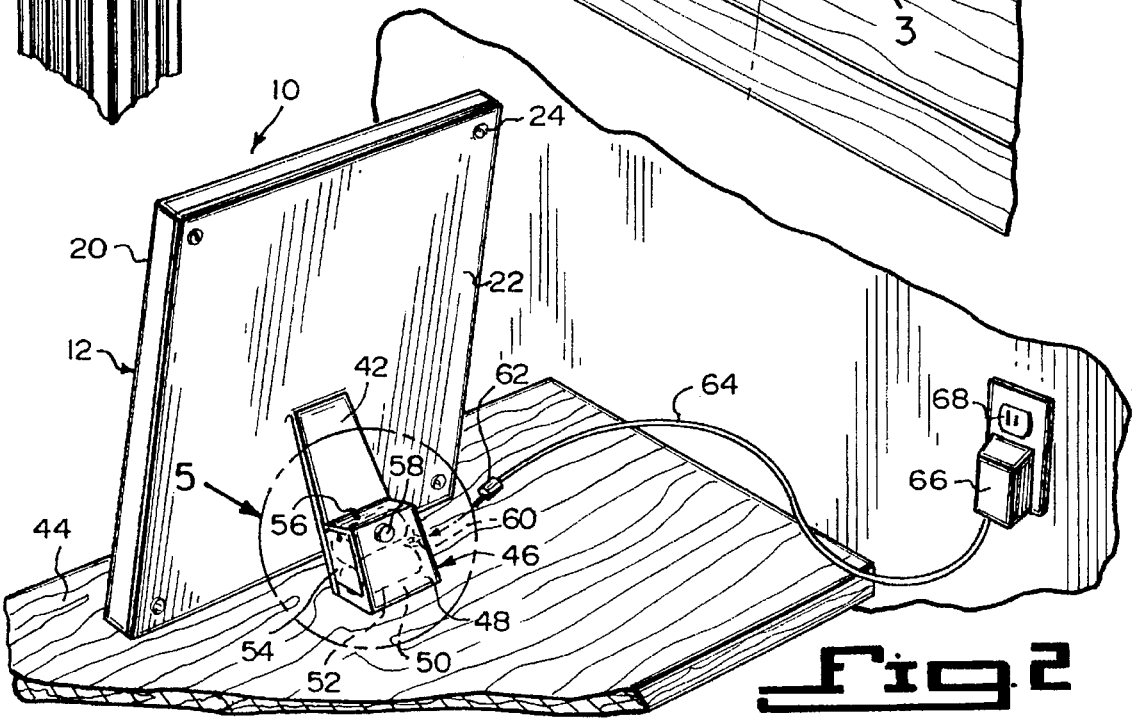
FIG. 2 is a rear perspective view taken in the direction of arrow 2 in FIG. 1.

A stand 42 extends from the backing plate 22, so that the stand 42 will support the picture frame 12 upon a horizontal flat surface 44, such as a table top shown in FIGS. 1 and 2. A power source 46 is carried on the stand 42, for supplying electrical power to the light producing facility 18.

The power source 46 contains a battery pack housing 48 mounted on the stand 42. The battery pack housing 48 has a compartment 50, for holding at least one battery 52 therein for supplying the electrical power. A door 54 is on the battery pack housing 48, for sealing the at least one battery 52 within the compartment 50.

An on/off switch 56 is on the battery pack housing 48, to turn the electrical power on and off. A control switch 58 is on the battery pack housing 48, to control operation of the light producing facility 18.

An AC adaptor jack 60 is on the battery pack housing 48. When a plug 62 on an electrical cord 64 from a transformer 66 plugged into a wall outlet 68 is inserted into the AC adaptor jack 60, electric power will be supplied to the light producing facility 18 therefrom, instead of from the at least one battery 52.

An auxiliary light source 70, such as a neon light tube, 70 can be placed between the molding 20 and the one-way mirror 14, to provide additional light therefrom. A motion detector 72 can be built into a bottom portion of the picture frame 12, so as to turn the light producing facility 18 on automatically when a person comes in front of the one-way mirror 14. A silent alarm 74 can also be built into a bottom portion of the picture frame 12, so as to warn a person at a remote location that another person has come in front of the one-way mirror 14.

| LIST OF REFERENCE NUMBERS | |
|---|---|
| 10 | picture illumination display device |
| 12 | picture frame of 10 |
| 14 | one-way mirror of 10 |
| 16 | picture of 10 |
| 18 | light producing facility of 10 |
| 20 | molding on 12 |
| 22 | backing plate of 12 |
| 24 | mounting screw for 22 |
| 26 | photographic slide for 16 |
| 28 | photograph on 26 |
| 30 | painting on 26 |
| 32 | drawing on 26 |
| 34 | light bar assembly for 18 |
| 36 | transparent panel of 34 |
| 38 | mirrored panel of 34 |
| 40 | cylindrical lamp of 34 |
| 42 | stand on 22 |
| 44 | horizontal flat surface |
| 46 | power source on 42 |
| 48 | battery pack housing of 46 |
| 50 | compartment in 48 |
| 52 | battery for 50 |
| 54 | door on 48 |
| 56 | on/off switch on 48 |
| 58 | control switch on 48 |
| 60 | AC adaptor jack on 48 |
| 62 | plug on 64 |
| 64 | electrical cord from 66 |
| 66 | transformer in 68 |
| 68 | wall outlet |
| 70 | auxiliary light source behind 20 |
| 72 | motion detector in 12 |
| 74 | silent alarm in 12 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A picture illumination display device comprising:

a) a picture frame having an opening, said opening having a width and a length;

b) a one-way mirror in said picture frame comprising a flat, uninterrupted mirrored surface, said flat, uninterrupted mirrored surface having a width and length which are larger than said width and length of said opening, so that when a person normally looks into said one-way mirror a reflection will be seen;

c) a picture carried in said picture frame behind said one-way mirror;

d) means behind said picture for producing light, so that once said light producing means is activated an image of said picture will be projected through said one-way mirror, to allow a person looking into said one-way mirror to see the projected image from said picture, said light producing means comprising a flat transparent panel having an uninterrupted surface behind said picture, a light bar assembly consisting of cylindrical lamps in a parallel arrangement behind said transparent panel, and a panel with an uninterrupted flat mirrored surface facing and parallel to said one-way mirror and said transparent panel and located immediately behind said lamps; and e) motion detector means built into a bottom portion of said frame to turn said light producing means on automatically when a person comes in front of said one-way mirror.

2. A picture illumination display device as recited in claim 1, wherein said picture frame includes a backing plate to retain said light producing means therein.

3. A picture illumination display device as recited in claim 2, wherein said picture frame includes a plurality of mounting screws for holding said backing plate thereto in a removable manner, to allow a person to gain access to said light producing means to repair and replace said light producing means when needed.

4. A picture illumination display device as recited in claim 1, wherein said picture is a photographic slide.

5. A picture illumination display device as recited in claim 4, wherein said photographic slide includes a photograph visually represented thereon.

6. A picture illumination display device as recited in claim 4, wherein said photographic slide includes a painting visually represented thereon.

7. A picture illumination display device as recited in claim 4, wherein said photographic slide includes a drawing visually represented thereon.

8. A picture illumination display device as recited in claim 2, further including a stand extending from said backing plate, so that said stand will support said picture frame upon a horizontal flat surface.

9. A picture illumination display device as recited in claim 8, further including a power source carried on said stand, for supplying electrical power to said light producing means.

10. A picture illumination display device as recited in claim 9, wherein said power source includes:

a) a battery pack housing mounted on said stand, said battery pack housing having a compartment, for holding at least one battery therein for supplying the electrical power; and b) a door on said battery pack housing for sealing the at least one battery within the compartment.

11. A picture illumination display device as recited in claim 10, further including:

a) an on/off switch on said battery pack housing, to turn the electrical power on and off; and b) a control switch on said battery pack housing, to control operation of said light producing means.

12. A picture illumination display device as recited in claim 10, further including an AC adaptor jack on said battery pack housing, so that when a plug on an electrical cord from a transformer plugged into a wall outlet is inserted into said AC adaptor jack, electric power will be supplied to said light producing means therefrom, instead of from said at least one battery.

13. A picture illumination display device as recited in claim 1, further including a silent alarm built into a bottom portion of said picture frame, so as to warn a person at a remote location that another person has come in front of said one-way mirror.

* * * * *